US006860999B2

(12) United States Patent
Greaney et al.

(10) Patent No.: US 6,860,999 B2
(45) Date of Patent: Mar. 1, 2005

(54) LIQUID HYDROCARBON TREATMENT METHOD

(75) Inventors: Mark A. Greaney, Upper Black Eddy, PA (US); Bihn N. Le, Humble, TX (US); Daniel P. Leta, Flemington, NJ (US); John N. Begasse, Livingston, NJ (US); Charles T. Huang, Houston, TX (US); Verlin Keith Turner, LaPorte, TX (US)

(73) Assignees: ExxonMobil Research and Engineering Company, Annandale, NJ (US); Merichem Company, Houston, TX (US)

( * ) Notice: Subject to any disclaimer, the term of this patent is extended or adjusted under 35 U.S.C. 154(b) by 138 days.

(21) Appl. No.: 10/161,906

(22) Filed: Jun. 4, 2002

(65) Prior Publication Data

US 2003/0085181 A1 May 8, 2003

Related U.S. Application Data

(60) Provisional application No. 60/299,329, filed on Jun. 19, 2001, provisional application No. 60/299,330, filed on Jun. 19, 2001, provisional application No. 60/299,331, filed on Jun. 19, 2001, provisional application No. 60/299,346, filed on Jun. 19, 2001, and provisional application No. 60/299,347, filed on Jun. 19, 2001.

(51) Int. Cl.[7] ..... C02F 1/68

(52) U.S. Cl. ..... 210/634; 210/749; 208/203; 208/230

(58) Field of Search ..... 208/203, 230–235; 210/749, 634

(56) References Cited

U.S. PATENT DOCUMENTS

| | | | | |
|---|---|---|---|---|
| 2,770,581 A | | 11/1956 | Brooks, Jr. et al. | 196/41 |
| 2,850,434 A | | 9/1958 | Brooks, Jr. et al. | 196/32 |
| 2,853,432 A | | 9/1958 | Gleim et al. | 196/32 |
| 2,868,722 A | | 1/1959 | Brooks, Jr. et al. | 208/263 |
| 2,882,224 A | | 4/1959 | Gleim et al. | 208/206 |
| 2,921,021 A | | 1/1960 | Urban et al. | 208/205 |
| 2,966,453 A | | 12/1960 | Gleim et al. | 208/206 |
| 2,976,229 A | | 3/1961 | Brown et al. | 208/2 |
| 3,186,934 A | | 6/1965 | Neilsen | 208/2 |
| 3,445,380 A | | 5/1969 | Urban | 208/206 |
| 3,977,829 A | | 8/1976 | Clonts | 23/267 |
| 3,992,156 A | | 11/1976 | Clonts | 23/267 |
| 4,040,947 A | | 8/1977 | Christman | 208/235 |
| 4,104,155 A | | 8/1978 | Christman | 208/235 |
| 4,265,735 A | | 5/1981 | Audeh et al. | 208/234 |
| 4,362,614 A | | 12/1982 | Asdigian | 208/235 |
| 4,404,098 A | | 9/1983 | Asdigian | 208/235 |
| 4,753,722 A | | 6/1988 | Le et al. | 208/207 |
| 5,318,690 A | | 6/1994 | Fletcher et al. | 208/89 |
| 5,360,532 A | | 11/1994 | Fletcher et al. | 208/89 |
| 5,569,788 A | | 10/1996 | Forte et al. | 568/697 |
| 5,582,714 A | | 12/1996 | Forte | 208/237 |
| 5,689,033 A | | 11/1997 | Forte et al. | 585/833 |
| 5,961,819 A | * | 10/1999 | Lee et al. | 208/230 |
| 5,997,731 A | | 12/1999 | Suarez | 208/230 |
| 6,007,704 A | | 12/1999 | Chapus et al. | 208/218 |
| 6,126,814 A | | 10/2000 | Lapinski et al. | 208/217 |
| 6,228,254 B1 | | 5/2001 | Jossens et al. | 208/212 |
| 6,352,640 B1 | | 3/2002 | Cook et al. | 208/237 |

* cited by examiner

*Primary Examiner*—Terry K. Cecil
(74) *Attorney, Agent, or Firm*—Gerard J. Hughes

(57) ABSTRACT

The invention relates to a method for treating and upgrading a hydrocarbon containing acidic species such as mercaptans, comprising:

(a) contacting the hydrocarbon, in the essential absence of oxygen, with a first phase of a treatment composition containing water, dissolved alkali metal hydroxide, cobalt phthalocyanine sulfonate, and dissolved alkylphenylates and having at least two phases, (i) the first phase containing water, alkali metal alkylphenylate, dissolved alkali metal hydroxide, and dissolved sulfonated cobalt phthalocyanine, and (ii) the second phase containing water and dissolved alkali metal hydroxide; and then (b) separating an upgraded hydrocarbon.

30 Claims, 2 Drawing Sheets n=1 : 3-methyl phenol
n=2 : 2,4-dimethyl phenol
n=3 : 2,3,5 trimethyl phenol

LIQUID HYDROCARBON TREATMENT METHOD

CROSS-REFERENCE TO RELATED APPLICATIONS

This application claims benefit of U.S. Provisional Patent Applications Ser. Nos. 60/299,329; 60/299,330; 60/299,331; 60/299,346; and 60/299,347, all filed on Jun. 19, 2001.

FIELD OF THE INVENTION

The invention relates to a method for treating liquid hydrocarbons in order to remove acidic impurities, such as mercaptans, particularly mercaptans having a molecular weight of about $C_4$ ($C_4H_{10}S$=90 g/mole) and higher, such as recombinant mercaptans.

BACKGROUND OF THE INVENTION

Undesirable acidic species such as mercaptans may be removed from liquid hydrocarbons with conventional aqueous treatment methods. In one conventional method, the hydrocarbon contacts an aqueous treatment solution containing an alkali metal hydroxide. The hydrocarbon contacts the treatment solution, and mercaptans are extracted from the hydrocarbon to the treatment solution where they form mercaptide species. The hydrocarbon and the treatment solution are then separated, and a treated hydrocarbon is conducted away from the process. Intimate contacting between the hydrocarbon and aqueous phase leads to more efficient transfer of the mercaptans from the hydrocarbon to the aqueous phase, particularly for mercaptans having a molecular weight higher than about $C_4$. Such intimate contacting often results in the formation of small discontinuous regions (also referred to as "dispersion") of treatment solution in the hydrocarbon. While the small aqueous regions provide sufficient surface area for efficient mercaptan transfer, they adversely affect the subsequent hydrocarbon separation step and may be undesirably entrained in the treated hydrocarbon.

Efficient contacting may be provided with reduced aqueous phase entrainment by employing contacting methods that employ little or no agitation. One such contacting method employs a mass transfer apparatus comprising substantially continuous elongate fibers mounted in a shroud. The fibers are selected to meet two criteria. The fibers are preferentially wetted by the treatment solution, and consequently present a large surface area to the hydrocarbon without substantial dispersion or the aqueous phase in the hydrocarbon. Even so, the formation of discontinuous regions of aqueous treatment solution is not eliminated, particularly in continuous process.

In another conventional method, the aqueous treatment solution is prepared by forming two aqueous phases. The first aqueous phase contains alkylphenols, such as cresols (in the form of the alkali metal salt), and alkali metal hydroxide, and the second aqueous phase contains alkali metal hydroxide. Upon contacting the hydrocarbon to be treated, mercaptans contained in hydrocarbon are removed from the hydrocarbon to the first phase, which has a lower mass density than the second aqueous phase. Undesirable aqueous phase entrainment is also present in this method, and is made worse when employing higher viscosity treatment solutions containing higher alkali metal hydroxide concentration.

There remains a need, therefore, for new hydrocarbon treatment processes that curtail aqueous treatment solution entrainment in the treated hydrocarbon, and are effective for removing acidic species such as mercaptan, especially high molecular weight and branched mercaptans.

SUMMARY OF THE INVENTION

In an embodiment, the invention relates to a method for treating and upgrading a hydrocarbon containing acidic species such as mercaptans, particularly mercaptans having a molecular weight higher than about $C_4$ such as recombinant mercaptans, comprising:

(a) contacting the hydrocarbon with a first phase of a treatment composition containing water, alkali metal hydroxide, cobalt phthalocyanine sulfonate, and alkylphenols and having at least two phases,
  (i) the first phase containing dissolved alkali metal alkylphenylate, dissolved alkali metal hydroxide, water, and dissolved sulfonated cobalt phthalocyanine, and
  (ii) the second phase containing water and dissolved alkali metal hydroxide; and then (b) separating an upgraded hydrocarbon.

In another embodiment, the invention relates to a method for treating and upgrading a hydrocarbon containing acidic species such as mercaptans, particularly mercaptans having a molecular weight higher than about $C_4$ such as recombinant mercaptans, comprising:

(a) combining water, alkali metal hydroxide, sulfonated cobalt phthalocyanine, and alkylphenols to form a treatment solution having at least an aqueous extractant phase and a more dense aqueous bottom phase substantially immiscible in the extractant;

(b) contacting the hydrocarbon with the extractant phase; and then (c) separating an upgraded hydrocarbon having a reduced mercaptan concentration compared to the hydrocarbon.

In yet another an embodiment, the invention relates to a method for treating and upgrading a hydrocarbon containing acidic species such as mercaptans, particularly mercaptans having a molecular weight higher than about $C_4$ such as recombinant mercaptans, comprising:

(a) contacting the hydrocarbon with an extractant composition containing water, alkali metal hydroxide, cobalt phthalocyanine sulfonate, and alkylphenols, wherein
  (i) the extractant is substantially immiscible with its analogous aqueous alkali metal hydroxide, and
  (ii) the extractant contains water, dissolved alkali metal alkylphenylate, dissolved alkali metal hydroxide, and dissolved sulfonated cobalt phthalocyanine; and then (b) separating an upgraded hydrocarbon.

DETAILED DESCRIPTION OF THE INVENTION

The invention relates in part to the discovery that aqueous treatment solution entrainment into the treated hydrocarbon may be curtailed by adding to the treatment solution an effective amount of sulfonated cobalt phthalocyanine. While not wishing to be bound by any theory or model, it is believed that the presence of sulfonated cobalt phthalocyanine in the treatment solution lowers the interfacial energy between the aqueous treatment solution and the hydrocarbon, which enhances the rapid coalescence of the discontinuous aqueous regions in the hydrocarbon thereby enabling more effective separation of the treated hydrocarbon from the treatment solution.

In one embodiment, the invention relates to processes for reducing the sulfur content of a liquid hydrocarbon by the extraction of the acidic species such as mercaptans from the hydrocarbon to an aqueous treatment solution where the mercaptans subsist as mercaptides, and then separating a treated hydrocarbon substantially reduced in mercaptans from the treatment solution while curtailing treatment solution entrainment in the treated hydrocarbon. Preferably, the extraction of the mercaptans from the hydrocarbon to the treatment solution is conducted under anaerobic conditions, i.e., in the substantial absence of added oxygen. In other embodiments, one or more of the following may also be incorporated into the process:

(i) stripping away the mercaptides from the treatment solution by e.g., steam stripping, (ii) catalytic oxidation of the mercaptides in the treatment solution to form disulfides which may be removed therefrom, and (iii) regenerating the treatment solution for re-use.

Sulfonated cobalt phthalocyanine may be employed as a catalyst when the catalytic oxidation of the mercaptides is included in the process.

Figure 2:
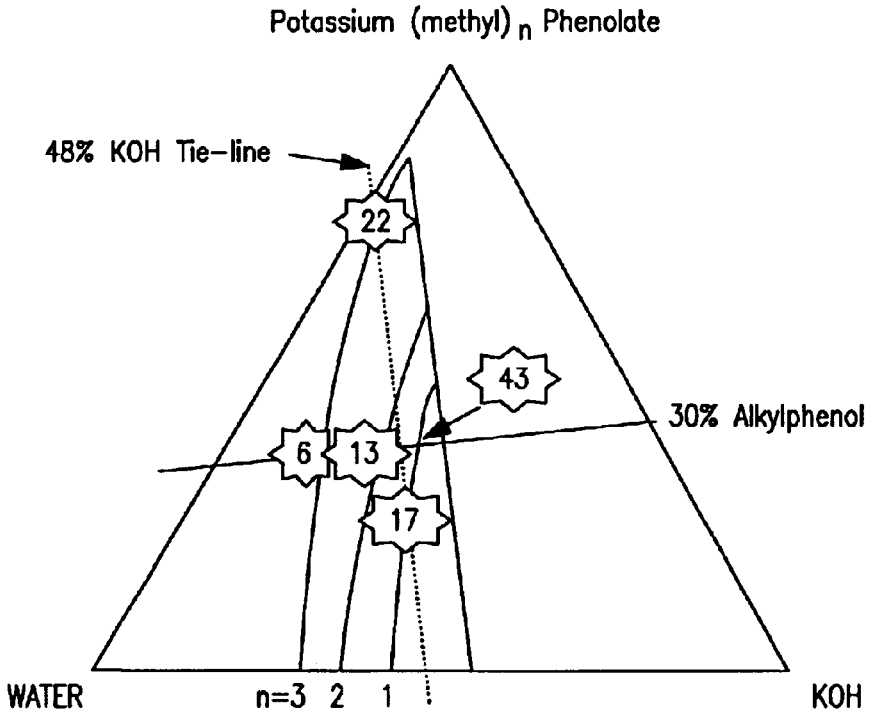
FIG. 2 shows a schematic phase diagram for a water-KOH-potassium alkyl phenylate treatment solution.

The treatment solution may be prepared by combining alkali metal hydroxide, alkylphenols, sulfonated cobalt pthalocyanine, and water. The amounts of the constituents may be regulated so that the treatment solution forms two substantially immiscible phases, i.e., a less dense, homogeneous, top phase of dissolved alkali metal hydroxide, alkali metal alkylphenylate, and water, and a more dense, homogeneous, bottom phase of dissolved alkali metal hydroxide and water. An amount of solid alkali metal hydroxide may be present, preferably a small amount (e.g., 10 wt. % in excess of the solubility limit), as a buffer, for example. When the treatment solution contains both top and bottom phases, the top phase is frequently referred to as the extractant or extractant phase. The top and bottom phases are liquid, and are substantially immiscible in equilibrium in a temperature ranging from about 80° F. to about 150° F. and a pressure range of about ambient (zero psig) to about 200 psig. Representative phase diagrams for a treatment solution formed from potassium hydroxide, water, and three different alkylphenols are shown in FIG. 2.

In one embodiment, therefore, a two-phase treatment solution is combined with the hydrocarbon to be treated and allowed to settle. Following settling, less dense treated hydrocarbon located above the top phase, and may be separated. In another embodiment, the top and bottom phases are separated before the top phase (extractant) contacts the hydrocarbon. As discussed, all or a portion of the top phase may be regenerated following contact with the hydrocarbon and returned to the process for re-use. For example, the regenerated top phase may be returned to the treatment solution prior to top phase separation, where it may be added to either the top phase, bottom phase, or both. Alternatively, the regenerated top phase may be added to the either top phase, bottom phase, or both subsequent to the separation of the top and bottom phases.

The treatment solution may also be prepared to produce a single liquid phase of dissolved alkali metal hydroxide, alkali metal alkylphenylate, sulfonated cobalt pthalocyanine, and water provided the single phase formed is compositionally located on the phase boundary between the one-phase and two-phase regions of the ternary phase diagram. In other words, the top phase may be prepared directly without a bottom phase, provided the top phase composition is regulated to remain at the boundary between the one phase and two phase regions of the dissolved alkali metal hydroxide-alkali metal alkylphenylate-water ternary phase diagram. The compositional location of the treatment solution may be ascertained by determining its miscibility with the analogous aqueous alkali metal hydroxide. The analogous aqueous alkali metal hydroxide is the bottom phase that would be present if the treatment solution had been prepared with compositions within the two-phase region of the phase diagram. As the top phase and bottom phase are homogeneous and immiscible, a treatment solution prepared without a bottom phase will be immiscible in the analogous aqueous alkali metal hydroxide.

Once an alkali metal hydroxide and alkylphenol (or mixture of alkyl phenols) are selected, a phase diagram defining the composition at which the mixture subsists in a single phase or as two or more phases may be determined. The phase diagram may be represented as a ternary phase diagram as shown in FIG. 2. A composition in the two phase region is in the form of a less dense top phase on the boundary of the one phase and two phase regions an a more dense bottom phase on the water-alkali metal hydroxide axis. A particular top phase is connected to its analogous bottom phase by a unique tie line. The relative amounts of alkali metal hydroxide, alkyl phenol, and water needed to form the desired single phase treatment solution at the phase boundary may then be determined directly from the phase diagram. If it is found that a single phase treatment solution has been prepared, but is not compositionally located at the phase boundary as desired, a combination of water removal or alkali metal hydroxide addition may be employed to bring the treatment solution's composition to the phase boundary. Since properly prepared treatment solutions of this embodiment will be substantially immiscible with its analogous aqueous alkali metal hydroxide, the desired composition may be prepared and then tested for miscibility with its analogous aqueous alkali metal hydroxide, and compositionally adjusted, if required.

Accordingly, in another embodiment, a single-phase treatment solution is prepared compositionally located at the boundary between one and two liquid phases on the ternary phase diagram, and then contacted with the hydrocarbon. After the treatment solution has been used to contact the hydrocarbon, it may be regenerated for re-use, as discussed for two-phase treatment solutions, but no bottom phase is present in this embodiment. Such a single-phase treatment solution is also referred to as an extractant, even when no bottom phase is present. Accordingly, when the treatment solution is located compositionally in the two-phase region of the phase diagram, the top phase is referred to as the extractant. When the treatment solution is prepared without a bottom phase, the treatment solution is referred to as the extractant.

While it is generally desirable to separate and remove sulfur from the hydrocarbon so as to form an upgraded hydrocarbon with a lower total sulfur content, it is not necessary to do so. For example, it may be sufficient to convert sulfur present in the feed into a different molecular form. In one such process, referred to as sweetening, undesirable mercaptans which are odorous are converted in the presence of oxygen to substantially less odorous disulfide species. The hydrocarbon-soluble disulfides then equilibrate (reverse extract) into the treated hydrocarbon. While the sweetened hydrocarbon product and the feed contain similar amounts of sulfur, the sweetened product contains less sulfur in the form of undesirable mercaptan species. The sweetened hydrocarbon may be further processed to reduce the total sulfur amount, by hydrotreating, for example.

The total sulfur amount in the hydrocarbon product may be reduced by removing sulfur species such as disulfides from the extractant. Therefore, in one embodiment, the invention relates to processes for treating a liquid hydrocarbon by the extraction of the mercaptans from the hydrocarbon to an aqueous treatment solution where the mercaptans subsist as water-soluble mercaptides and then converting the water-soluble mercaptides to water-insoluble disulfides. The sulfur, now in the form of hydrocarbon-soluble disulfides, may then be separated from the treatment solution and conducted away from the process so that a treated hydrocarbon substantially free of mercaptans and of reduced sulfur content may be separated from the process. In yet another embodiment, a second hydrocarbon may be employed to facilitate separation of the disulfides and conduct them away from the process.

Depending on the embodiment, the process may be continuous, batch, or a combination thereof. If continuous, the method may be operated so that the flow of the treatment solution is cocurrent to hydrocarbon flow, countercurrent to hydrocarbon flow, or combination thereof.

In one embodiment, the hydrocarbon is a liquid hydrocarbon containing acidic species such as mercaptans and having a viscosity in the range of about 0.1 to about 5 cP. Representative hydrocarbons include one or more of natural gas condensates, liquid petroleum gas (LPG), butanes, butenes, gasoline streams, jet fuels, kerosenes, naphthas and the like. A preferred hydrocarbon is a cracked naphtha such as an FCC naphtha or coker naphtha boiling in the range of about 100° F. to about 400° F. Such hydrocarbon streams can typically contain one or more mercaptan compounds, such as methyl mercaptan, ethyl mercaptan, n-propyl mercaptan, isopropyl mercaptan, n-butyl mercaptan, thiophenol and higher molecular weight mercaptans. The mercaptan compound is frequently represented by the symbol RSH, where R is normal or branched alkyl, or aryl.

Natural gas condensates, which are typically formed by extracting and condensing natural gas species above about $C_4$, frequently contain mercaptans that are not readily converted by conventional methods. Natural gas condensates typically have a boiling point ranging from about 100° F. to about 700° F. and have mercaptan sulfur present in an amount ranging from about 100 ppm to 2000 ppm, based on the weight of the condensate. The mercaptans range in molecular weight upwards from about $C_5$, and may be present as straight chain, branched, or both. Consequently, in one embodiment natural gas condensates are preferred hydrocarbon for use as feeds for the instant process.

Mercaptans and other sulfur-containing species, such as thiophenes, often form during heavy oil and resid cracking and coking and as a result of their similar boiling ranges are frequently present in the cracked products. Cracked naphtha, such as FCC naphtha, coker naphtha, and the like, also may contain desirable olefin species that when present contribute to an enhanced octane number for the cracked product. While hydrotreating may be employed to remove undesirable sulfur species and other heteroatoms from the cracked naphtha, it is frequently the objective to do so without undue olefin saturation. Hydrodesulfurization without undue olefin saturation is frequently referred to as selective hydrotreating. Unfortunately, hydrogen sulfide formed during hydrotreating reacts with the preserved olefins to form mercaptans. Such mercaptans are referred to as reversion or recombinant mercaptans to distinguish them from the mercaptans present in the cracked naphtha conducted to the hydrotreater. Such reversion mercaptans generally have a molecular weight ranging from about 90 to about 160 g/mole, and generally exceed the molecular weight of the mercaptans formed during heavy oil, gas oil, and resid cracking or coking, as these typically range in molecular weight from 48 to about 76 g/mole. The higher molecular weight of the reversion mercaptans and the branched nature of their hydrocarbon component make them more difficult to remove from the naphtha using conventional caustic extraction. Accordingly, a preferred hydrocarbon is a hydrotreated naphtha boiling in the range of about 130° F. to about 350° F. and containing reversion mercaptan sulfur in an amount ranging from about 10 to about 100 wppm, based on the weight of the hydrotreated naphtha. More preferred is a selectively hydrotreated hydrocarbon, i.e., one that is more than 80 wt. % (more preferably 90 wt. % and still more preferably 95 wt. %) desulfurized compared to the hydrotreater feed but with more than 30% (more preferably 50% and still more preferably 60%) of the olefins retained based on the amount of olefin in the hydrotreater feed.

In one embodiment, the hydrocarbon to be treated is contacted with a first phase of an aqueous treatment solution having two phases. The first phase contains dissolved alkali metal hydroxide, water, alkali metal alkylphenylate, and sulfonated cobalt phthalocyanine, and the second phase contains water and dissolved alkali metal hydroxide. Preferably, the alkali metal hydroxide is potassium hydroxide. The contacting between the treatment solution's first phase and the hydrocarbon may be liquid-liquid. Alternatively, a vapor hydrocarbon may contact a liquid treatment solution. Conventional contacting equipment such as packed tower, bubble tray, stirred vessel, fiber contacting, rotating disc contactor and other contacting apparatus may be employed. Fiber contacting is preferred. Fiber contacting, also called mass transfer contacting, where large surface areas provide for mass transfer in a non-dispersive manner is described in U.S. Pat. Nos. 3,997,829; 3,992,156; and 4,753,722. While contacting temperature and pressure may range from about 80° F. to about 150° F. and 0 psig to about 200 psig, preferably the contacting occurs at a temperature in the range of about 100° F. to about 140° F. and a pressure in the range of about 0 psig to about 200 psig, more preferably about 50 psig. Higher pressures during contacting may be desirable to elevate the boiling point of the hydrocarbon so that the contacting may conducted with the hydrocarbon in the liquid phase.

The treatment solution employed contains at least two aqueous phases, and is formed by combining alkylphenols, alkali metal hydroxide, sulfonated cobalt phthalocyanine, and water. Preferred alkylphenols include cresols, xylenols, methylethyl phenols, trimethyl phenols, naphthols, alkylnaphthols, thiophenols, alkylthiophenols, and similar phenolics. Cresols are particularly preferred. When alkylphenols are present in the hydrocarbon to be treated, all or a portion of the alkylphenols in the treatment solution may be obtained from the hydrocarbon feed. Sodium and potassium hydroxide are preferred metal hydroxides, with potassium hydroxide being particularly preferred. Di-, tri- and tetra-sulfonated cobalt pthalocyanines are preferred cobalt pthalocyanines, with cobalt phthalocyanine disulfonate being particularly preferred. The treatment solution components are present in the following amounts, based on the weight of the treatment solution: water, in an amount ranging from about 10 to about 50 wt. %; alkylphenol, in an amount ranging from about 15 to about 55 wt. %; sulfonated cobalt phthalocyanine, in an amount ranging from about 10 to about 500 wppm; and alkali metal hydroxide, in an amount ranging from about 25 to about 60 wt. %. The extractant should be present in an amount ranging from about 3 vol. % to about 100 vol. %, based on the volume of hydrocarbon to be treated.

As discussed, the treatment solution's components may be combined to form a solution having a phase diagram such as shown in FIG. 2, which shows the two-phase region for three different alkyl phenols, potassium hydroxide, and water. The preferred treatment solution has component concentrations such that the treatment solution will either (i) be compositionally in the two-phase region of the water-alkali metal hydroxide-alkali metal alkylphenylate phase diagram and will therefore form a top phase compositionally located at the phase boundary between the one and two-phase regions and a bottom phase, or (ii) be compositionally located at the phase boundary between the one and two-phase regions, with no bottom phase.

Following selection of the alkali metal hydroxide and the alkylphenol or alkylphenol mixture, the treatment solution's ternary phase diagram may be determined by conventional methods thereby fixing the relative amounts of water, alkali metal hydroxide, and alkyl phenol. The phase diagram can be empirically determined when the alkyl phenols are obtained from the hydrocarbon. Alternatively, the amounts and species of the alkylphenols in the hydrocarbon can be measured, and the phase diagram determined using conventional thermodynamics. The phase diagram is determined when the aqueous phase or phases are liquid and in a temperature in the range of about 80° F. to about 150° F. and a pressure in the range of about ambient (0 psig) to about 200 psig. While not shown as an axis on the phase diagram, the treatment solution contains dissolved sulfonated cobalt phthalocyanine. By dissolved sulfonated cobalt pthalocyanine, it is meant dissolved, dispersed, or suspended, as is known.

Whether the treatment solution is prepared in the two-phase region of the phase diagram or prepared at the phase boundary, the extractant will have a dissolved alkali metal alkylphenylate concentration ranging from about 10 wt. % to about 95 wt. %, a dissolved alkali metal hydroxide concentration in the range of about 1 wt. % to about 40 wt. %, and about 10 wppm to about 500 wppm sulfonated cobalt pthalocyanine, based on the weight of the extractant, with the balance being water. When present, the second (or bottom) phase will have an alkali metal hydroxide concentration in the range of about 45 wt. % to about 60 wt. %, based on the weight of the bottom phase, with the balance being water.

When extraction of higher molecular weight mercaptans (about $C_4$ and above, preferably about $C_5$ and above, and particularly from about $C_5$ to about $C_8$) is desired, such as in reversion mercaptan extraction, it is preferable to form the treatment solution towards the right hand side of the two-phase region, i.e., the region of higher alkali metal hydroxide concentration in the bottom phase. It has been discovered that higher extraction efficiency for the higher molecular weight mercaptans can be obtained at these higher alkali metal hydroxide concentrations. The conventional difficulty of treatment solution entrainment in the treated hydrocarbon, particularly at the higher viscosities encountered at higher alkali metal hydroxide concentration, is overcome by providing sulfonated cobalt phthalocyanine in the treatment solution. As is clear from FIG. 2, the mercaptan extraction efficiency is set by the concentration of alkali metal hydroxide present in the treatment solution's bottom phase, and is substantially independent of the amount and molecular weight of the alkylphenol, provided more than a minimum of about 5 wt. % alkylphenol is present, based on the weight of the treatment solution.

The extraction efficiency, as measured by the extraction coefficient, $K_{eq}$, shown in FIG. 2 is preferably higher than about 10, and is preferably in the range of about 20 to about 60. Still more preferably, the alkali metal hydroxide in the treatment solution is present in an amount within about 10% of the amount to provide saturated alkali metal hydroxide in the second phase. As used herein, $K_{eq}$ is the concentration of mercaptide in the extractant divided by the mercaptan concentration in the product, on a weight basis, in equilibrium, following mercaptan extraction from the feed hydrocarbon to the extractant.

Figure 1:
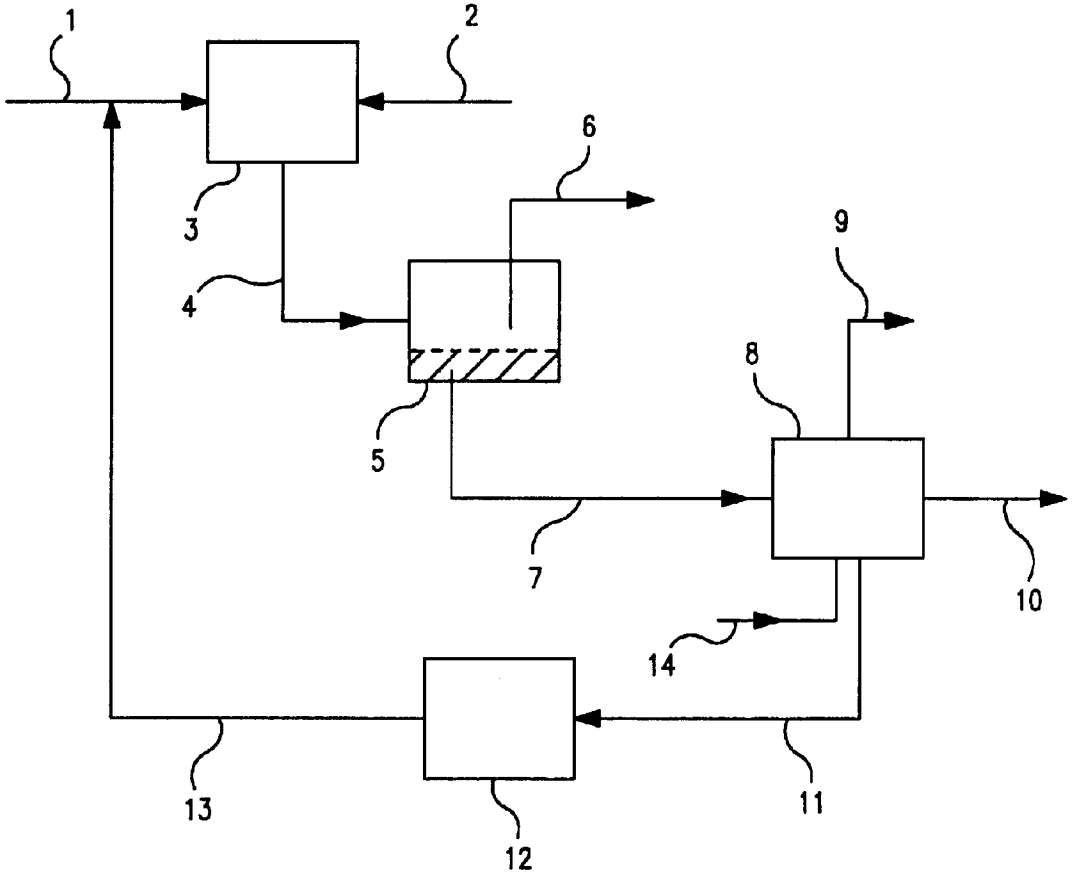
FIG. 1 shows a schematic flow diagram for one embodiment.

A simplified flow diagram for one embodiment is illustrated in FIG. 1. Extractant in line 1 and a hydrocarbon feed in line 2 are conducted to mixing region 3 where mercaptans are removed from the hydrocarbon to the extractant. Hydrocarbon and extractant are conducted through line 4 to settling region 5 where the treated hydrocarbon is separated and conducted away from the process via line 6. The extractant, now containing mercaptides, is shown in the lower (hatched) portion of the settling region. A bottom phase (not shown) may be present.

In a preferred embodiment, the extractant is conducted via line 7 to oxidizing region 8 where the mercaptides in the extractant are oxidized to disulfides in the presence of an oxygen-containing gas conducted to region 8 via line 14. Undesirable oxidation by-products such as water and off-gasses may be conducted away from the process via line 9. The disulfides may be conducted away from the process via line 10, or alternatively combined with the hydrocarbon of line 6. In one embodiment, the contacting, settling, and oxidizing occur in a common vessel with no interconnecting lines. In that embodiment, gravitational separation of the less dense hydrocarbon from the more dense extractant may be employed to facilitate mercaptan sulfur removal from the hydrocarbon. As discussed, the disulfide sulfur may be returned to the hydrocarbon if desired.

Extractant may be conducted away from the process via line 11. Alternatively, an optional polishing step may be employed to remove remaining disulfides from the extractant in region 12, and the polished extractant may be returned to the process via line 13. In another embodiment, not illustrated, the polished extractant's composition is adjusted by regulating the water content, alkali metal hydroxide content, alkyl phenol content, sulfonated cobalt pthalocyanine, or some combination thereof prior to introducing the polished extractant into the contacting region. However, such compositional adjustment may occur before or after the polished extractant is combined with fresh extractant.

EXAMPLE 1

Impact of Sulfonated Cobalt Pthalocyanine on Droplet Size Distribution

A LASENTECH™ (Laser Sensor Technology, Inc., Redmond, Wash. USA), Focused Laser Beam Reflecatance Measuring Device (FBRM®) was used to monitor the size of dispersed aqueous potassium cresylate droplets in a continuous naphtha phase. The instrument measures the back-reflectance from a rapidly spinning laser beam to determine the distribution of "chord lengths" for particles that pass through the point of focus of the beam. In the case of spherical particles, the chord length is directly proportional to particle diameter. The data is collected as the number of counts per second sorted by chord length in one thousand linear size bins. Several hundred thousand chord lengths are typically measured per second to provide a statistically significant measure of chord length size distribution. This methodology is especially suited to detecting changes in this distribution as a function of changing process variables.

In this experiment, a representative treatment solution was prepared by combining 90 grams of KOH, 50 grams of water and 100 grams of 3-ethyl phenol at room temperature. After stirring for thirty minutes, the top and bottom phases were allowed to separate and the less dense top phase was utilized as the extractant. The top phase had a composition of about 36 wt. % KOH ions, about 44 wt. % potassium 3-ethyl phenol ions, and about 20 wt. % water, based on the total weight of the top phase, and the bottom phase contained approximately 53 wt. % KOH ions, with the balance water, based on the weight of the bottom phase.

First, 200 mls of light virgin naphtha was stirred at 400 rpm and the FBRM probe detected very low counts/sec to determine a background noise level. Then, 20 mls of the top phase from the KOH/alkyl phenol/water mixture described above was added. The dispersion that formed was allowed to stir for 10 minutes at room temperature. At this time the FBRM provided a stable histogram for the chord length distribution. Then, while still stirring at 400 rpm, a sulfonated cobalt pthalocyanine was added. The dispersion immediately responded to the addition, with the FBRM recording a significant and abrupt change in the chord length distribution. Over the course of another five minutes, the solution stabilized at a new chord length distribution. The most noticeable impact of the addition of sulfonated cobalt pthalocyanine was to shift the median chord length to larger values (length weighted): without sulfonated cobalt pthalocyanine, 14 microns; after addition of sulfonated cobalt pthalocyanine, 35 microns.

It is believed that the sulfonated cobalt pthalocyanine acts to reduce the surface tension of the dispersed extractant droplets, which results in their coalescence into larger median size droplets. In a preferred embodiment, where non-dispersive contacting is employed using, e.g., a fiber contactor, this reduced surface tension has two effects. First, the reduced surface tension enhances transfer of mercaptides from the naphtha phase into the extractant which is constrained as a film on the fiber during the contacting. Second, any incidental entrainment would be curtailed by the presence of the sulfonated cobalt pthalocyanine.

EXAMPLE 2

Determination of Extraction Coefficients for Selectively Hydrotreated Naphtha Determination of mercaptan extraction coefficient, $K_{eq}$, was conducted as follows. About 50 m is of selectively hydrotreated naphtha was poured into a 250 ml Schlenck flask to which had been added a Teflon-coated stir bar. This flask was attached to an inert gas/vacuum manifold by rubber tubing. The naphtha was degassed by repeated evacuation/nitrogen refill cycles (20 times). Oxygen was removed during these experiments to prevent reacting the extracted mercaptide anions with oxygen, which would produce naphtha-soluble disulfides. Due to the relatively high volatility of naphtha at room temperature, two ten mls sample of the degassed naphtha were removed by syringe at this point to obtain total sulfur in the feed following degassing. Typically the sulfur content was increased by 2–7-wppm sulfur due to evaporative losses. Following degassing, the naphtha was placed in a temperature-controlled oil bath and equilibrated at 120° F. with stirring. Following a determination of the ternary phase diagram for the desired components, the extractant for the run was prepared so that it was located compositionally in the two-phase region. Excess extractant was also prepared, degassed, the desired volume is measured and then transferred to the stirring naphtha by syringe using standard inert atmosphere handling techniques. The naphtha and extractant were stirred vigorously for five minutes at 120° F., then the stirring was stopped and the two phases were allowed to separate. After about five minutes, twenty mls of extracted naphtha were removed while still under nitrogen atmosphere and loaded into two sample vials. Typically, two samples of the original feed were also analyzed for a total sulfur determination, by x-ray fluorescence. The samples are all analyzed in duplicate, in order to ensure data integrity. The reasonable assumption was made that all sulfur removed from the feed resulted from mercaptan extraction into the aqueous extractant. This assumption was verified on several runs in which the mercaptan content was measured. As discussed, the Extraction Coefficient, $K_{eq}$, is defined as the ratio of sulfur concentration present in the form of mercaptans ("mercaptan sulfur") in the extractant divided by the concentration of sulfur in the form or mercaptides (also called "mercaptan sulfur") in the selectively hydrotreated naphtha following extraction:

$$K_{eq} = \frac{[RS^{-}M^{+} \text{ in extractant}]}{[RSH \text{ in feed}]} \text{ after extraction.}$$

EXAMPLE 3

Extraction Coefficients Determined At Constant Cresol Weight %

As is illustrated in FIG. 2 the area of the two-phase region in the phase diagram increases with alkylphenol molecular weight. These phase diagrams were determined experimentally by standard, conventional methods. The phase boundary line shifts as a function of molecular weight and also determines the composition of the extractant phase within the two-phase region. In order to compare the extractive power of two-phase extractants prepared from different molecular weight alkylphenols, extractants were prepared having a constant alkylphenol content in the top layer of about 30 wt. %. Accordingly, starting composition were selected for each of three different molecular weight alkylphenols to achieve this concentration in the extractant phase. On this basis, 3-methylphenol, 2,4-dimethylphenol and 2,3,5-trimethylphenol were compared and the results are depicted in FIG. 2.

The figure shows the phase boundary for each of the alkylphenols with the 30% alkylphenol line is shown as a sloping line intersecting the phase boundary lines. The measured $K_{eq}$ for each extractant, on a wt./wt. basis are noted at the point of intersection between the 30% alkyl phenol line and the respective alkylphenol phase boundary. The measured $K_{eq}$S for 3-methylphenol, 2,4-dimethylphenol, and 2,3,5-trimethylphenol were 43, 13, and 6 respectively. As can be seen in this figure, the extraction coefficients for the two-phase extractant at constant alkylphenol content drop significantly as the molecular weight of the alkylphenol increases. Though the heavier alkylphenols produce relatively larger two-phase regions in the phase diagram, they exhibit reduced mercaptan extraction power for the extractants obtained at a constant alkylphenol content. A second basis for comparing the extractive power of two-phase extractant systems is also illustrated in FIG. 2. The dashed 48% KOH tie-line delineates compositions in the phase diagram which fall within the two-phase region and share the same second phase (or more dense phase, frequently referred to as a bottom phase) composition: 48 wt. % KOH. All starting compositions along this tie-line will phase separate into two phases, the bottom phase of which will be 48 wt. % KOH in water. Two extractant compositions were prepared such that they fell on this tie-line although they were prepared using different molecular weight alkylphenols: 3-methyl phenol and 2,3,5 trimethylphenol. The extraction coefficients were determined as described above and were found to be 17 and 22 respectively. Surprisingly, in contrast to the constant alkylphenol content experiments in which large differences in extractive power were observed, these two extractants showed nearly identical $K_{eq}$. This example demonstrates that the mercaptan extraction efficiency is determined by the concentration of alkali metal hydroxide present in the bottom phase, and is substantially independent of the amount and molecular weight of the alkyl phenol.

EXAMPLE 4

Measurement of Mercaptan Removal from Naphtha

A representative treatment solution was prepared by combining 458 grams of KOH, 246 grams of water and 198 grams of alkyl phenols at room temperature. After stirring for thirty minutes, the mixture was allowed to separate into two phases, which were separated. The extractant (less dense) phase had a composition of about 21 wt. % KOH ions, about 48 wt. % potassium methyl phenylate ions, and about 31 wt. % water, based on the total weight of the extractant, and the bottom (more dense) phase contained approximately 53 wt % KOH ions, with the balance water, based on the weight of the bottom phase.

One part by weight of the extractant phase was combined with three parts by weight of a selectively hydrotreated intermediate cat naphtha ("ICN") having an initial boiling point of about 90° F. The ICN contained $C_6$, $C_7$, and $C_8$ recombinant mercaptans. The ICN and extractant were equilibrated at ambient pressure and 135° F., and the concentration of $C_6$, $C_7$, and $C_8$ recombinant mercaptan sulfur in the naphtha and the concentration of $C_6$, $C_7$, and $C_8$ recombinant mercaptan sulfur in the extractant were determined. The resulting $K_{eq}$ s were calculated and are shown in column 1 of the table.

For comparison, a conventional (from the prior art) extraction of normal mercaptans from gasoline using a 15 wt. % sodium hydroxide solution at 90° F. is shown in column 2 of the table. The comparison demonstrates that the extraction power of the more difficult to extract recombinant mercaptans using the instant process is more than 100 times greater than the extractive power of the conventional process with the less readily extracted normal mercaptans.

| Mercaptan Molecular Weight | $K_{eq}$, Extractant from top phase | $K_{eq}$, Single phase extractant |
|---|---|---|
| $C_1$ | — | 1000 |
| $C_2$ | — | 160 |
| $C_3$ | — | 30 |
| $C_4$ | — | 5 |
| $C_5$ | — | 1 |
| $C_6$ | 15.1 | 0.15 |
| $C_7$ | 7.6 | 0.03 |
| $C_8$ | 1.18 | Not measurable |

As is clear from the table, greatly enhanced $K_{eq}$ is obtained when the extractant is the top phase of a two-phase treatment solution compared with a conventional extractant, i.e., an extractant obtained from a single-phase treatment solution not compositionally located on the boundary between the one phase and two-phase regions. The top phase extractant is particularly effective for removing high molecular weight mercaptans. For example, for $C_6$ mercaptans, the $K_{eq}$ of the top phase extractant is one hundred times larger than the $K_{eq}$ obtained using an extractant prepared from a single-phase treatment solution. The large increase in $K_{eq}$ is particularly surprising in view of the higher equilibrium temperature employed with the top phase extractant because conventional kinetic considerations would be expected to lead to a decreased $K_{eq}$ as the equilibrium temperature was increased from 90° F. to 135° F.

EXAMPLE 5

Mercaptan Extraction from Natural Gas Condensates

A representative two-phase treatment solution was prepared as in as in Example 4. The extractant phase had a composition of about 21 wt. % KOH ions, about 48 wt. % potassium dimethyl phenylate ions, and about 31 wt. % water, based on the total weight of the extractant, and the bottom phase contained approximately 52 wt. % KOH ions, with the balance water, based on the weight of the bottom phase.

One part by weight of the extractant was combined with three parts by weight of a natural gas condensate containing branched and straight-chain mercaptans having molecular weights of about $C_5$ and above. The natural gas condensate had an initial boiling point of 91° F. and a final boiling point of 659° F., and about 1030 ppm mercaptan sulfur. After equilibrating at ambient pressure and 130° F., the mercaptan sulfur concentration in the extractant was measured and compared to the mercaptan concentration in the condensate, yielding a $K_{eq}$ of 11.27.

For comparison, the same natural gas condensate was combined on a 3:1 weight basis with a conventional extractant prepared from a conventional single phase treatment composition that contained 15% dissolved sodium hydroxide, i.e., a treatment composition compositionally located well away from the boundary with the two-phase region on the ternary phase diagram. Following equilibration under the same conditions, the mercaptan sulfur concentration was determined, yielding a much smaller $K_{eq}$ of 0.13. This example demonstrates that the extractant prepared from a two-phase treatment solution is nearly two orders of magnitude more effective in removing from a hydrocarbon branched and straight-chain mercaptans having a molecular weight greater than about $C_5$.

EXAMPLE 6

Reversion Mercaptan Extractive Power of Single versus Two-Phase Extraction Compositions of Nearly Identical Composition Three treatment compositions were prepared (runs numbered 2, 4, and 6) compositionally located within the two-phase region. Following its separation from the treatment composition, the top phase (extractant) was contacted with naphtha as set forth in example 2, and the $K_{eq}$ for each extractant was determined. The naphtha contained reversion mercaptans, including reversion mercaptans having molecular weights of about $C_5$ and above. The results are set forth in the table.

By way of comparison, three conventional treatment compositions were prepared (runs numbered 1, 3, and 5) compositionally located in the single-phase region of the ternary phase diagram, but near the boundary of the two-phase region. The treatment compositions were contacted with the same naphtha, also under the conditions set forth in example 2, and the $K_{eq}$ was determined. These results are also set forth in the table.

For reversion mercaptan removal, the table clearly shows the benefit of employing extractant compositionally located on the phase boundary between the one-phase and two-phase regions of the phase diagram. Extractants compositionally located near the phase boundary, but within the one-phase region, show a $K_{eq}$ about a factor of two lower than the $K_{eq}$ of similar extractants compositionally located at the phase boundary.

| Run# | # of phases in treatment composition | K-cresylate (wt. %) | KOH (wt. %) | Water (wt. %) | Keq (wt./wt.) |
|---|---|---|---|---|---|
| 1 | 1 | 15 | 34 | 51 | 6 |
| 2 | 2 | 15 | 35 | 50 | 13 |
| 3 | 1 | 31 | 27 | 42 | 15 |
| 4 | 2 | 31 | 28 | 41 | 26 |
| 5 | 1 | 43 | 21 | 34 | 18 |
| 6 | 2 | 43 | 22 | 35 | 36 |

What is claimed is:

1. A method for upgrading a hydrocarbon containing mercaptans, comprising:

(a) contacting the hydrocarbon, in the essential absence of oxygen, with a first phase of a treatment composition containing water, alkali metal hydroxide, cobalt phthalocyanine, and alkylphenols and having at least two phases, (i) the first phase containing dissolved alkali metal alkylphenylate, dissolved alkali metal hydroxide, water, and dissolved sulfonated cobalt phthalocyanine, and (ii) the second phase containing water and dissolved alkali metal hydroxide; and then (b) separating an upgraded hydrocarbon.

2. The method of claim 1 wherein, during the contacting of step (a), the first phase is applied to and flows over and along hydrophylic metal fibers, and the hydrocarbon flows over the first phase co-current with first phase flow.

3. The method of claim 2 wherein the hydrocarbon contains a hydrotreated naphtha and at least a portion of the mercaptans are reversion mercaptans.

4. The method of claim 3 wherein the hydrotreated naphtha is a selectively hydrotreated naphtha and wherein the reversion mercaptans have a molecular weight greater than about $C_4$.

5. The method of claim 4 wherein the reversion mercaptans have a molecular weight greater than about $C_5$.

6. The method of claim 1 wherein the sulfonated cobalt phthalocyanine is present in the first phase in an amount ranging from about 10 to about 500 wppm, based upon the weight of the treatment solution.

7. The method of claim 1 wherein the treatment solution contains about 15 wt. % to about 55 wt. % dissolved alkylphenols, about 10 wppm to about 500 wppm disaolved sulfonated cobalt phthalocyanine, about 25 wt. % to about 60 wt. % dissolved alkali metal hydroxide, and about 10 wt. % to about 50 wt. % water, based on the weight of the treatment solution.

8. The method of claim 7 wherein the first phase is present in step (a) in an amount ranging from about 3 vol. % to about 100 vol. % based on the volume of the hydrocarbon, and the contacting is conducted in the substantial absence of oxygen.

9. The method of claim 1 wherein the alkylphenols are cresols.

10. The method of claim 1 wherein at least a portion of the alkylphenols are obtained from the hydrocarbon.

11. The method of claim 1 wherein the sulfonated cobalt phthalocyanine is cobalt phthalocyanine disulfonate.

12. A method for removing mercaptans from a hydrocarbon, comprising:

(a) combining water, alkali metal hydroxide, sulfonated cobalt phthalocyanine, and alkylphenols to form a treatment solution having at least an aqueous extractant and a more dense aqueous bottom phase substantially immiscible in the extractant;

(b) contacting the hydrocarbon with the extractant; and then (c) separating an upgraded hydrocarbon having a reduced mercaptan concentration compared to the hydrocarbon, wherein the treatment composition is formed by combining water in an amount ranging from about 10 wt. % to about 50 wt. %, alkali metal hydroxide in an amount ranging from about 2 wt. % to about 60 wt %, sulfonated cobalt phthalocyanine in an amount ranging from about 10 ppm to about 500 ppm, and alkylphenols in an amount ranging from about 10 wt. % to about 50 wt. % based on the weight of the treatment solution in order to diminish the entrainment of the extractant in the hydrocarbon.

13. The method of claim 12 wherein, during the contacting of step (b), the first phase is applied to and flows over and along hydrophylic metal fibers, and the hydrocarbon flows over the first phase co-current with first phase flow.

14. The method of claim 13 wherein the hydrocarbon contains a hydrotreated naphtha and at least a portion of the mercaptans are reversion mercaptans having a molecular weight greater than about $C_4$.

15. The method of claim 14 wherein the hydrotreated naphtha a selectively hydrotreated hydrocarbon and wherein the reversion mercaptans have a molecular weight greater than about $C_5$.

16. The method of claim 14 wherein the sulfonated cobalt phthalocyanine is present in the extractant in an amount ranging from about 10 wppm to about 500 wppm, based upon the weight of the treatment solution.

17. The method of claim 12 wherein the extractant is present in amount ranging from about 3 vol. % to about 100 vol. %, based on the volume of the hydrocarbon, and wherein the extractant contains, dissolved alkali metal hydroxide in an amount ranging from about 1 wt. % to about 40 wt %, dissolved alkali metal alkylphenylate ions in an amount ranging from about 10 wt. % to about 95 wt. %, and sulfonated cobalt pthalocyanine in an amount ranging from about 10 ppm to about 500 ppm, based on the weight of the extractant.

18. The method of claim 17 wherein the alkylphenols are cresols.

19. The method of claim 12 wherein at least a portion of the alkylphenols are obtained from the hydrocarbon.

20. The method of claim 12 wherein the sulfonated cobalt phthalocyanine is cobalt phthalocyanine disulfonate.

21. The method of claim 12 wherein the contacting is conducted in the substantial absence of oxygen.

22. The method for treating and upgrading a hydrocarbon containing mercaptans, comprising:

(a) contacting the hydrocarbon with an extractant composition formed by combining water, alkali metal hydroxide, cobalt phthalocyanine sulfonate, and alkylphenols, wherein (i) the extractant is substantially immiscible with its analogous aqueous alkali metal hydroxide, and (ii) the extractant contains water, dissolved alkali metal alkylphenylate, dissolved alkali metal hydroxide, and dissolved sulfonated cobalt phthalocyanine; and then (b) separating an upgraded hydrocarbon.

23. The method of claim 22 wherein, during the contacting of step (a), the first phase is applied to and flows over and along hydrophylic metal fibers, and the hydrocarbon flows over the first phase co-current with first phase flow.

24. The method of claim 23 wherein the hydrocarbon contains a hydrotreated naphtha and at least a portion of the mercaptans are reversion mercaptans having a molecular weight greater than about $C_4$.

25. The method of claim 24 wherein the hydrotreated naphtha is a selectively hydrotreated naphtha and wherein the reversion mercaptans have a molecular weight greater than about $C_5$.

26. The method of claim 24 wherein the treatment composition is formed by combining water in an amount ranging from about 10 wt. % to about 50 wt. %, alkali metal hydroxide in an amount ranging from about 25 wt. % to about 60 wt. %, sulfonated cobalt phthalocyanine in an amount ranging from about 10 ppm to about 500 ppm, and alkylphenols in an amount ranging from about 10 wt. % to about 50 wt. %, based on the weight of the treatment solution.

27. The method of claim 26 wherein the extractant is present in an amount ranging from about 3 vol. % to about 100 vol. %, based on the volume of the hydrocarbon, and wherein the extractant contains dissolved alkali metal hydroxide in an amount ranging from about 1 wt. % to about 40 wt. %, dissolved alkali metal alkylphenylate ions in an amount ranging from about 10 wt. % to about 95 wt. %, and sulfonated cobalt pthalocyanine in an amount ranging from about 10 ppm to about 500 ppm, based on the weight of the extractant.

28. The method of claim 22 wherein the alkylphenols are cresols and at least a portion of the cresols are obtained from the hydrocarbon.

29. The method of claim 23 wherein the sulfonated cobalt phthalocyanine is cobalt phthalocyanine disulfonate.

30. The method of claim 22 wherein the contacting is conducted in the substantial absence of oxygen.

* * * * *